United States Patent [19]

Deisting

[11] 3,975,013

[45] Aug. 17, 1976

[54] SHEET FEEDING DEVICE

[75] Inventor: Horst Deisting, Berlin, Germany

[73] Assignee: Pitney-Bowes, Inc., Stamford, Conn.

[22] Filed: Apr. 16, 1975

[21] Appl. No.: 568,590

[30] Foreign Application Priority Data

Apr. 25, 1974 Germany ..... 2420165

[52] U.S. Cl. ..... 271/275; 271/272

[51] Int. Cl.[2] ..... B65H 5/02

[58] Field of Search ..... 271/6, 7, 264, 272, 271/273, 274, 275, 277, 198

[56] References Cited

UNITED STATES PATENTS

| | | | |
|---|---|---|---|
| 1,252,681 | 1/1918 | Friess | 271/198 |
| 3,860,232 | 1/1975 | Martin | 271/198 |

*Primary Examiner*—Evon C. Blunk
*Assistant Examiner*—Robert Saifer
*Attorney, Agent, or Firm*—Peter Vrahotes; William D. Soltow, Jr.; Albert W. Scribner

[57] ABSTRACT

This invention relates to a sheet feeding device for the horizontal guidance of sheets leaving a separating device. The sheets are fed to an operating station, preferably the printing station of an address printing machine. The sheet feeding device comprises two opposed conveyor belts each being kept in tension and driven by guide rollers rotating in opposite direction. The sheets are received between the belts and conveyed by the same past the printing station. Adjusting means is provided to vary the location of the conveyor belts to accommodate various sized sheets.

7 Claims, 3 Drawing Figures

SHEET FEEDING DEVICE

BACKGROUND OF THE INVENTION

Sheet feeding devices using conveyor belts are already known, for example as disclosed in German OS 1 561 728. The conveyor belts used in such prior sheet feeding devices are arranged in a fixed position relative to the device to which they are connected. When such a sheet feeding device is employed for feeding to an address printing machine and the forms to be printed have different sizes or are to be printed in predetermined areas, disadvantages are encountered in the prior sheet feeding devices as such sheets cannot be engaged reliably by the conveyor belts so as to place them in the proper printing position.

The present invention provides an improvement over the aforesaid sheet feeding devices so that sheets, or forms, having various as well as unusual sizes can be fed in a proper printing stance without any difficulties, in safety and with ease to the respective operation position of an operating machine in order to be processed at a predetermined area of the sheets or forms.

SUMMARY OF THE INVENTION

The sheet feeding device according to the invention which solves the aforementioned problem has two conveyor belts that are received within a carrier arm of a belt guiding device. The carrier arm is arranged with its inlet end supported by a tie rod, which acts as a guide shaft, extending in a transverse direction. The belt guiding device is pivotally mounted on the shaft and is adapted to be shifted longitudinally relative to the guide shaft into various operation positions. The upstream end of the built guiding device is operatively connected to the supply hopper of a sheet separator.

The position of the belt guiding device can be selected by means of a few simple manipulations whereby the belt guiding device is shifted relative to the separating device. There are no difficulties also in printing accuracy if, for example, very small forms having extreme printing conditions as for instance small printing areas, are fed to the printing station.

The readjustment required for another printing location on the sheets or another size of forms is easily performed. As the belt guiding device is pivotally mounted on the guide shaft it can be lifted effortlessly before shifting. When the guide shaft is a part of a sheet feeding device, including a sheet separating device, then the swingability enables the belt guiding device to swing downwards into a vertical position and therewith saving space when the machine is not in use.

It has proven advantageous to have the guide roller of the lower conveyor belt at the inlet end shiftably arranged on a drive shaft which extends parallel to the guide shaft.

For facilitating the selection of specified shifting positions for the belt guiding device, grooves are located on the guide shaft which receive spring loaded locking projections associated with the belt guiding device.

As a further advantage, the supply hopper associated with the separating device is provided with a cut-out at the inlet end of the belt guiding device. The cut-out determines the extent of shiftability of the belt guiding device along the guide shaft and receives the shiftable guide roller mounted on the drive shaft which extends below the supply hopper.

Prior devices provided with a stationary belt guiding device need conveyor belts of very exact sizes as well as frequent readjustment of belt tension. These necessities have proven very disadvantageous. The shiftability of the belt guiding device eliminates the deficiencies of the prior known devices through use of the shiftable guiding device. It has been shown that automatic belt tension can be achieved if the belt guiding device includes a carrier arm having a guide roller shaft at one end which is urged away from the guide shaft by means of at least one tension spring. In this way, one of the guide rollers of the lower conveyor belt is urged away from the guide shaft to produce tension in the conveyor belt. The tension spring provides automatically the most suitable tension as required.

To achieve tension of the belt a feature found very advantageous is to have the carrier arm curved in the direction of the lower conveyor belt and provided with a number of small conveyor belt rollers in the side facing the lower conveyor belt. These small belt rollers support the lower portion of the upper conveyor belt. A construction is used wherein the carrier arm at its end opposite the guide shaft is connected to a carrier rod which extends in a transversal direction and whose length determines the maximum size of the forms to be fed. A tension shaft supports the guide roller of the lower conveyor belt opposite the guide shaft and the tension shaft extends in a parallel direction to the carrier rod. An expansion spring is received intermediate the ends of the carrier rod and the tension shaft tension element to enable the carrier rod and the tension shaft to move away from one another. In this preferred way, it is ensured that the belt tension means does not affect the feeding of the forms.

Forms to be transported are contacted by the opposed sides of the conveyor belts and are conveyed until they finally rest on the table of the operating machine. During further movement, the outside ends of the forms would normally butt against the tension shaft which carries the lower guide roller. For effectively avoiding this, the sheet feeding device has the further feature that the tension shaft and the guide shaft are at nearly the same level and the tension shaft carries at each side thereof baffles which extend under the carrier rod in the direction of the guide shaft and which have a slight downward inclination. More specifically, the outside ends of the baffles are curved downwardly to enable the forms to glide over these baffles. To simplify the construction without the risk of deformation, the form baffles have a trapezoidal shape and the front edges facing the guide shaft are bevelled in the direction of the tension shaft.

The carrier rod may be used in a very suitable way in order to obtain a further advantage by having the outside ends of the carrier rod serve as a support for the stacker, which in turn secures the belt guiding device in its operation position on the operating machine by means of its weight. This is achieved by the carrier rod of the belt guiding device having a length which corresponds to the width of the operating machine.

DESCRIPTION OF THE PREFERRED EMBODIMENT

Figure 1:
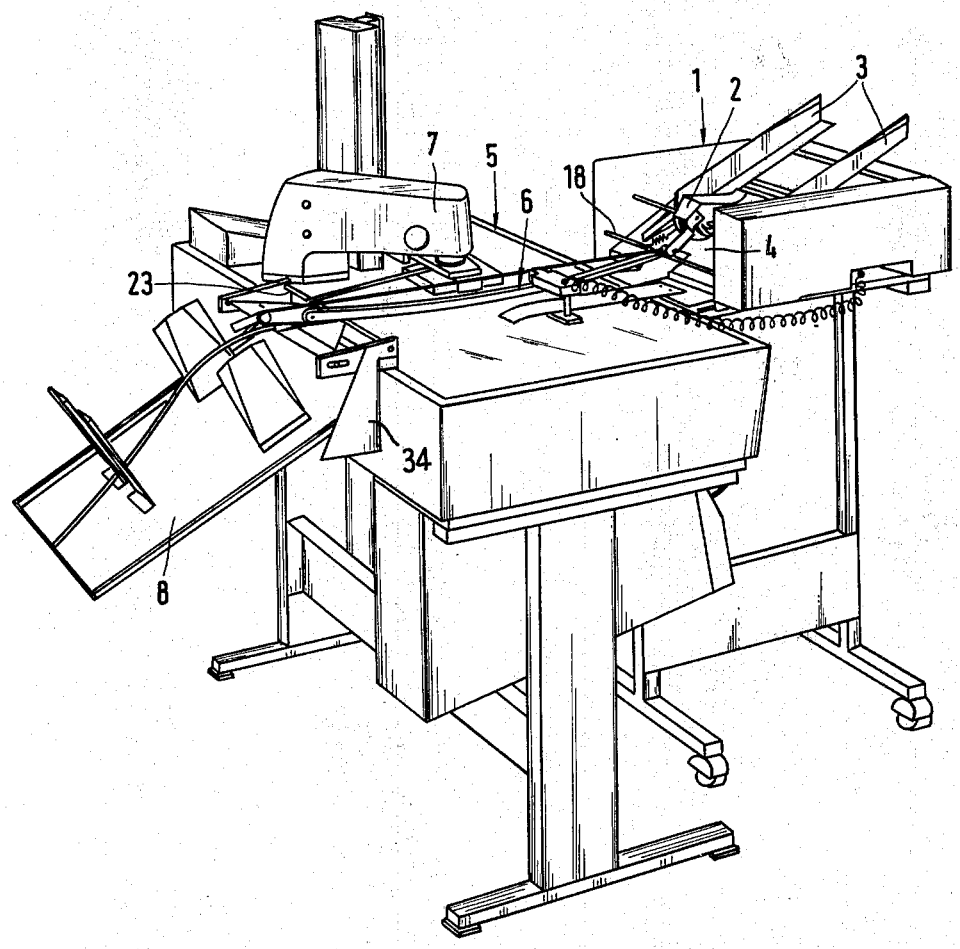
FIG. 1 is a perspective view of a document printer provided with a sheet feeding device according to the invention and a separating device.

A portable document feeder is generally shown at 1 in FIG. 1, and is provided with a sheet separating device 2 by means of which sheets 27 (or forms) to be processed are located in a stack between side guides 3 which are incorporated in an inclined supply hopper 4. The sheets 27 are forwarded separately to an address printing machine 5 which is connected to the document feeder 1. For this purpose, the document feeder 1 is provided with a sheet feeding device comprising a belt guiding device 6 by means of which sheets 27 can be fed one after another to a printing position beneath a printing head 7 and subsequently to a stacker 8.

Figure 2:
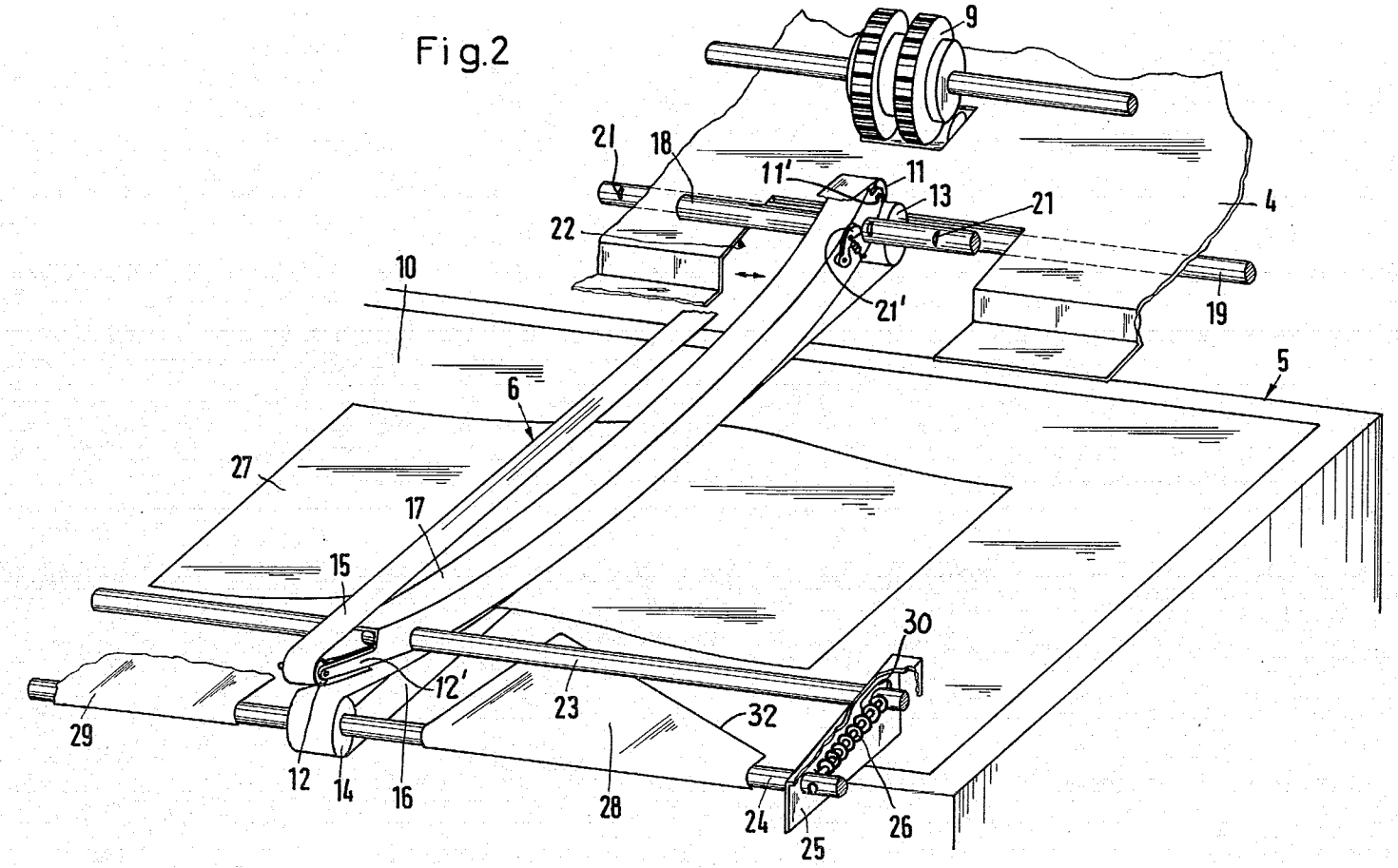
FIG. 2 is an enlarged, perspective view of the sheet feeding device that extends along the table of the document printer and a portion of the separating device shown in FIG. 1.

FIG. 2 shows, in an enlarged scale, a portion of the inclined supply hopper 4 from which, by means of a separator roller 9, the sheets 27 are individually forwarded to the table 10 of the address printing machine 5 in a printing position. The illustrated sheet feeding device 6 comprises an upper conveyor belt 15 and a lower conveyor belt 16 which are supported by and rotated in opposite directions by guide rollers 11, 12 and 13, 14, respectively. The belt guiding device 6 has a carrier arm 17 which is curved in the direction to the lower conveyor belt 16 and to which the rollers 11 and 12 are rotatably attached by braces 11′ and 12′ respectively. The inside of the carrier arm 17 is provided with a plurality of small conveyor belt rollers (not shown) which support the lower portion of the upper conveyor belt 15. The carrier arm 17 is pivotably mounted at its inlet end, in the area of the separator roller 9, on a transversely extending guide shaft 18. The carrier arm 17 is adapted to be moved along the guide shaft 18 in various operating positions. As may be seen from FIG. 1, the guide shaft 18 extends to both side guides 3 of the document feeder 1.

At the inlet end of the belt guiding device 6, a drive shaft 19 extends parallel to the guide shaft 18 and is connected to a feeder 1. The guide shaft 18 is located above the supply hopper 4. On this drive shaft 19, the guide roller 13 is shiftably mounted for rotation therewith, which guide roller rotatably supports the lower conveyor belt 16. Within a given area, shifting of the belt guiding device with the guide roller 13 is possible. For this purpose, the drive shaft 19 is provided with an adjusting spring, not shown in the drawing which engages a corresponding groove of a central bore hole of the guide roller 13.

Figure 3:
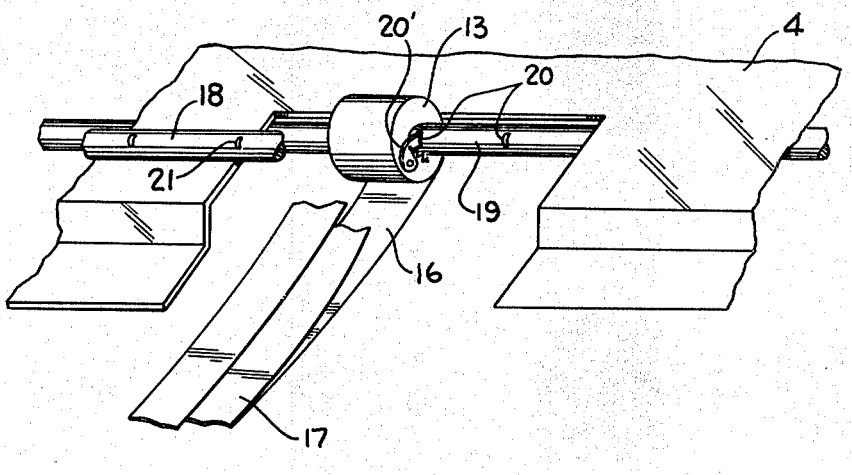
FIG. 3 is an enlarged, perspective view of a portion of the sheet feeding device shown in FIG. 2 with portions removed.

In order to make it possible that various fixed operating positions can be selected and easily adjusted, the drive shaft 19 and the guide shaft 18 are provided with grooves 20 and 21 respectively. These grooves 20, 21 are engaged by spring loaded projections 20′ secured to opposite sides of the carrier arm 17 and to the guide roller 13, respectively, as is shown in FIG. 3.

As can be seen from FIG. 2, the supply hopper 4 across which the guide shaft 18 extends has a cut-out 22 at the inlet end of the belt guiding device 6. This cut-out 22 determines the degree of shiftability of the belt guiding device along the guide shaft 18. The driven guide roller 13 projects into the cut-out 22.

The outlet end of the carrier arm 17 is connected to a transversely extending carrier rod 23. Extending parallel to this carrier rod 23 is a tension shaft 24 upon which the guide roller 14 of the lower conveyor belt 16 is rotatably mounted. Intermediate the carrier rod 23 and the tension shaft 24 of their respective ends is a tension element 25 having associated therewith a tension spring 26 provided as an expansion spring. The tension element 25 has an elongated slot 30 that enables relative movement between the carrier rod 23 and the tension shaft 24 in response to the effect of the spring 26. This spring 26 acts through the tension shaft 24 and the guide roller 14 to provide tension to the lower conveyor belt 16.

As can be seen from FIG. 2 the length of the carrier rod 23 as well as of the tension shaft 24 determine the maximum size of the sheets 27 that can be fed.

To ensure that a sheet 27 does not abut against the tension shaft 24 with its borders being turned away from the belt guiding device 6 during the conveyance of the sheets, the tension shaft 24 is provided with baffles 28, 29 having nearly trapezoidal shapes and being positioned on opposite sides of the guide roller 14 and having bevelled front edges facing the guide shaft 18. The baffles 28, 29 have a bevelled front edges 32 (only one being shown) in the direction of the ends of the tension shaft 24. These baffles 28, 29 are slightly inclined downwardly beneath the carrier rod 23, and more particularly with its acute-angled edges laying on the table 10 of the address printing machine 5. In this matter, they give assurance that the sheets 27 will glide along the bevelled front edges 32 to be lifted without disturbance and fed into the stacker 8 shown in FIG. 1.

The stacker 8 is operatively connected to the belt guiding device 6 in a way that the carrier rod 23 serves as a suspension member for the stacker 8. A pair of braces 34 are rotatably mounted on the ends of the carrier rod 23 and the braces support the stacker 8. This combination results the length of the carrier arm 17 of the belt guiding device 6 to correspond to the width of the address printing machine 5. Because of the weight of the stacker 8 bearing on the carrier rod 23, the same is secured in a way that the belt guiding device 6 is fixed in its operating position on the address printing machine 5.

What is claimed is:

1. A sheet feeding device for the longitudinal conveying of sheets from a document feeder to a printing station, the combination comprising: a first pair of longitudinally spaced guide rollers, means for rotatably supporting one of said first rollers, means secured to the document feeder for supporting and rotatably driving the other of said first rollers, a first conveying belt disposed about said first pair of rollers, a second pair of longitudinally spaced guide rollers, a laterally extending guide shaft supported by the document feeder, a longitudinally extending belt guiding member pivotably mounted on said guide shaft, said means for rotatably supporting said one of said first rollers being supported by said belt guiding member, means associated with said belt guiding member for rotatably supporting said second rollers at opposite ends of said belt guiding member, a second conveying belt disposed about said second pair of rollers, said second belt extending parallel to said first belt and being in operational engagement therewith, and means for laterally positioning said conveying belts and said belt guide member.

2. The sheet feeding device of claim 1 wherein said means for laterally positioning said conveyor belts and said belt guiding member comprises said belt guiding member being movable along the axis of said guide shaft, and locking means associated with said guiding member and said guide shaft.

3. A sheet feeding device for the longitudinal conveying of sheets from a document feeder to a printing station, the combination comprising: a drive shaft received within the document feeder, a drive roller mounted on said drive shaft for rotation therewith and operative to be moved along the axis of said drive shaft, means for locking said drive shaft at a various location along the axis of said drive shaft, a guide shaft received within the document feeder, a longitudinally extending carrier arm pivotably supported at one end by said guide shaft and operative to be moved along the axis of said guide shaft, means for locking said carrier arm at various postions along said guide shaft comprising a plurality of axially spaced grooves located on said drive shaft and said guide shaft and spring loaded projects secured to said drive shaft roller and said carrier arm which are operative to be received within said grooves of said drive shaft and said carrier shaft respectively, a guide roller, means assoicated with one end of said carrier arm for supporting said guide roller in the vicinity of said guide shaft, a laterally extending carrier rod received within the opposite end of said carrier arm, a carrier arm roller, support means associated with said carrier arm for rotatably supporting said carrier arm roller, a first belt disposed about said guide roller and said carrier arm roller, a portion of said first belt being received within said carrier arm, a support element disposed at each end of said carrier rod, a laterally extending support shaft received within said support elements, a support roller rotatably mounted on and operative to be moved axially along said support shaft, and a second belt disposed about said drive shaft roller and said support roller.

4. The sheet feeding device of claim 3 including a pair of baffles supported by said support shaft and extending toward the document feeder in a declining manner.

5. The sheet feeding device of claim 4 wherein said baffles have a trapezoidal configuration with the end addressing the document feeder being bevelled.

6. The sheet feeding device of claim 3 including means associated with said carrier rod and said support shaft to urge them apart thereby creating tension in said second belt.

7. The sheet feeding device of claim 3 wherein each of said support elements has a pair of openings therein, one of said openings receiving said carrier rod and the other opening receiving said support shaft and a biasing means connected to said carrier rod and said support shaft to urge the two apart.

* * * * *

UNITED STATES PATENT OFFICE

CERTIFICATE OF CORRECTION

Patent No. 3975013 Dated August 17, 1976

Inventor(s) Horst Deisting

It is certified that error appears in the above-identified patent and that said Letters Patent are hereby corrected as shown below:

Title page, column 1, line 3, change "[73] Assignee: Pitney-Bowes, Inc., Stamford, Conn." to --[73] Assignee: Adrema Pitney Bowes GmbH, Heppenheim, W. Germany--.

Claim 3, Column 5, line 19, change "postions" to --positions--.

Claim 3, Column 5, line 25, change "assoicated" to --associated--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*